US005803240A

United States Patent [19]

Swidersky et al.

[11] Patent Number: 5,803,240

[45] Date of Patent: Sep. 8, 1998

[54] ELECTRIC PUSH-BUTTON SWITCH

[75] Inventors: Norbert Swidersky, Heidenfahrt; Gerd Rudolph, Hauptstrasse, both of Germany

[73] Assignee: Eaton Controls GmbH & Co, Kg, Germany

[21] Appl. No.: 553,561

[22] PCT Filed: May 19, 1994

[86] PCT No.: PCT/DE94/00590

§ 371 Date: Sep. 3, 1996

§ 102(e) Date: Sep. 3, 1996

[87] PCT Pub. No.: WO94/28564

PCT Pub. Date: Dec. 8, 1994

[30] Foreign Application Priority Data

May 21, 1993 [DE] Germany ..... 43 16 998.8

[51] Int. Cl.[6] ..... H01H 13/70

[52] U.S. Cl. ..... 200/344; 200/341

[58] Field of Search ..... 200/344, 341, 200/345, 330, 520, 529

[56] References Cited

FOREIGN PATENT DOCUMENTS 2.175.105 10/1973 France .
3405654 8/1985 Germany .

*Primary Examiner*—David J. Walczak
*Attorney, Agent, or Firm*—Roger A. Johnston

[57] ABSTRACT

A push button switch having a push button installed in a switch housing wherein the push button is joined to the housing by two levers which are pivotally mounted on the housing and pivotally mounted on the push button and a link pivotally connected to the levers.

8 Claims, 6 Drawing Sheets

Figure 3:
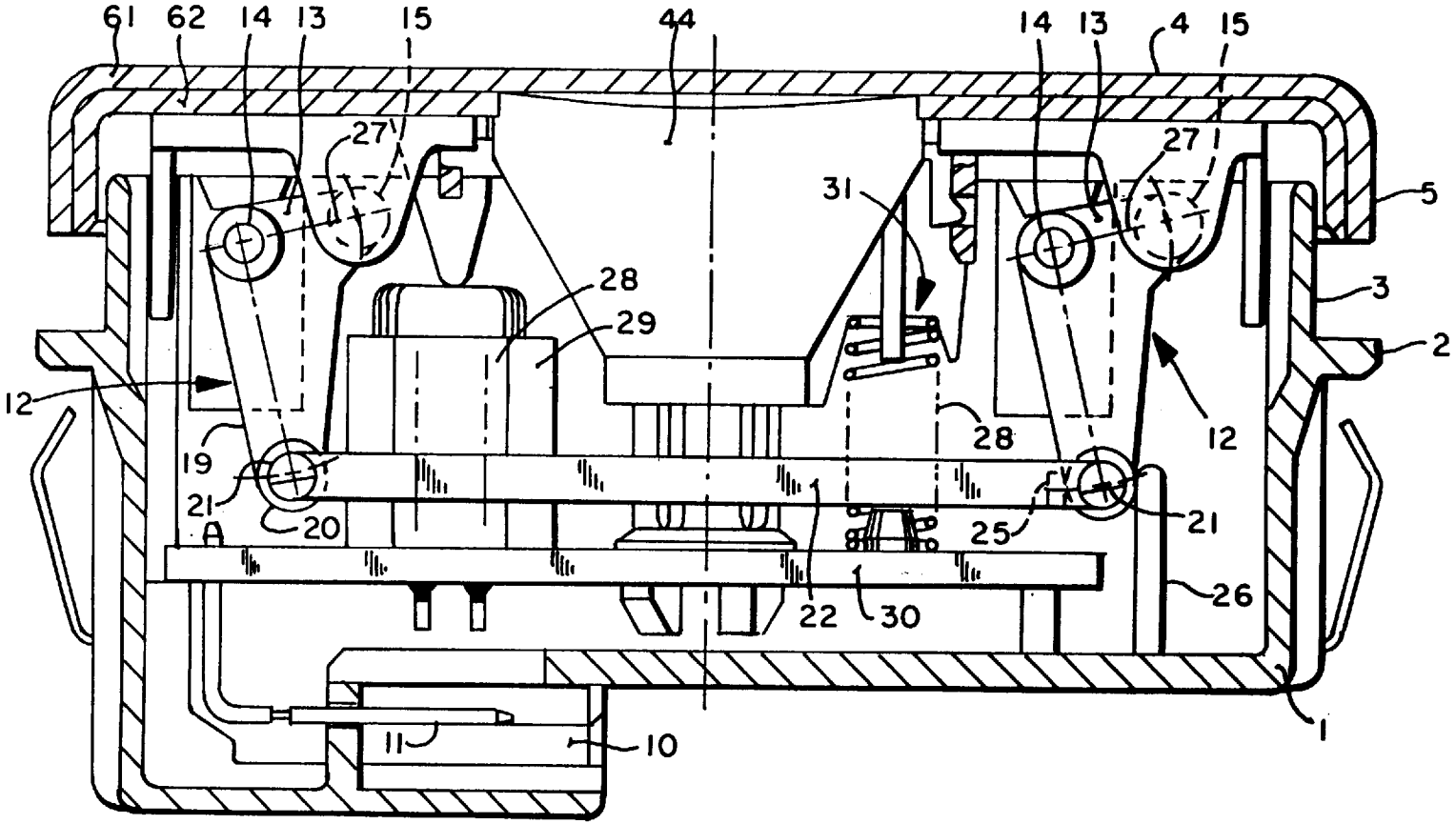

Fig. 1
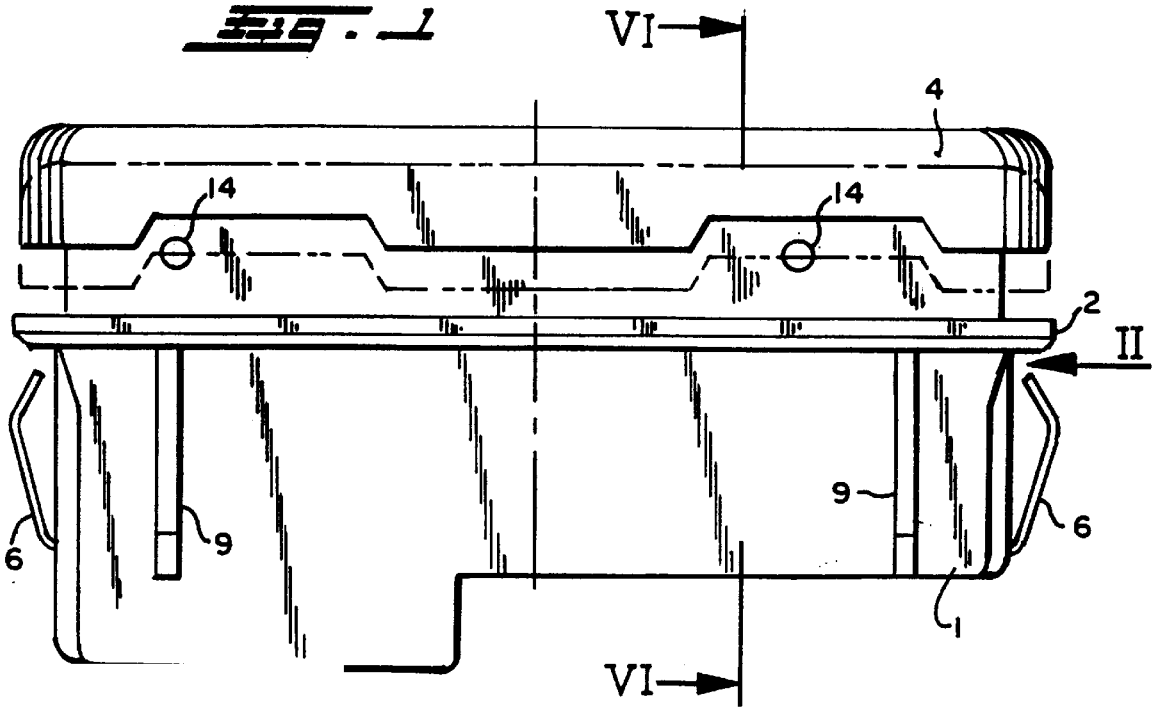
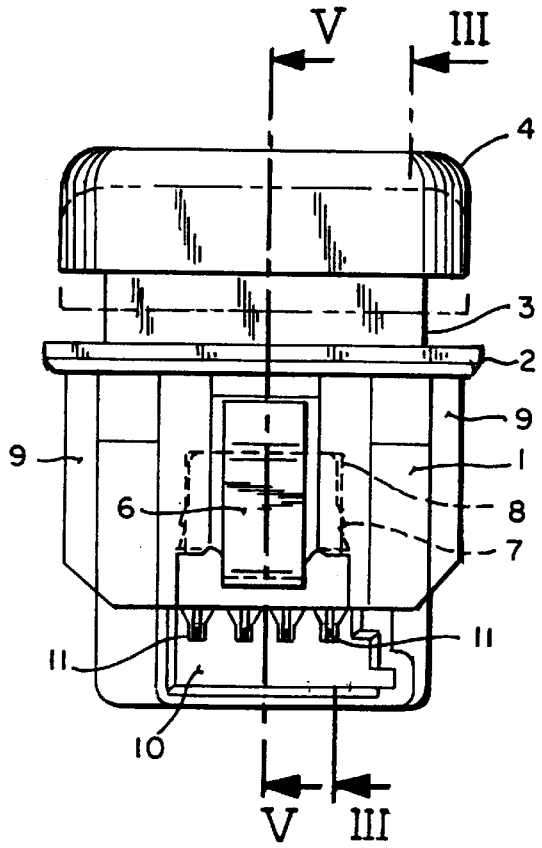
Fig. 2

ELECTRIC PUSH-BUTTON SWITCH

SPECIFICATION

The invention relates to an electric push-button switch, notably for automobiles, with a push button which, spring-loaded, is installed in the switch housing and joined to it in articulate fashion, by means of two levers which are arranged, for one, on a bearing in the housing and, for another, on a bearing in the push button, which bearing pivots about the aforementioned bearing, each lever featuring a projection with an entrainment bearing, and the two entrainment bearings being connected by a bar.

A push-button switch of this type is known from FR-A-2 175 105. It features a housing and a push button, where the push button is joined to the housing in articulate fashion, by means of two levers which are arranged on the push button, for one, on a stationary bearing in the housing and, for another, in a stationary bearing which pivots about the housing-specific bearing. The levers are comprised of triangular parts whose one point is occupied by the stationary bearing in the housing, the second point by the stationary bearing on the push button, and the third point by an entrainment bearing, with both entrainment bearings connected by a bar. The part of the triangle that connects the stationary bearing in the housing with the stationary bearing on the push button can be considered as the lever proper, while the remaining part may be considered as a projection that is integrally molded on. Following its actuation, the push button is restored to its starting position by a spring contained in the switch.

The objective underlying the invention is to provide an electric push-button switch of the initially mentioned type where the push button, when actuated one-sidedly, can be moved evenly, without skewing and binding, with at the same time large play between push button and housing as well as given tolerance compensation.

This objective is inventionally accomplished in that the housing-specific bearing for the one lever is stationary while the housing-specific bearing for the other lever is fashioned as a slot in the housing, and an elastic element acting against the push button engages the projection of the lever retained in the slot.

Besides a reliable actuation of the push-button switch, this measure accomplishes a tolerance compensation, since the force of the elastic element which is introduced via the projection on one of the levers and via the bar and against the working direction of the push button causes a fixing of the push button against the elastic element acting in the direction of said push button.

The embodiment of the invention provides for four levers which connect the housing in articulate fashion with the push button, where two levers each are aligned coaxially and connected by a bar. Accomplished thereby, when arranging the levers beneath the corners of a larger-area push button, is a frictionless depression of the push button, with the coaxial connection of two levers each effecting a forced entrainment of the two coaxial levers. The four levers, between the housing and the push button, are suitably connected by way of the bars mounted in their entrainment bearings, with a rail between the two bars. Thus, the displacement path is being transmitted from bar to bar, directly via the rail. Each lever is preferably connected to the pertaining bar by means of a clip or integrally via a film hinge.

To restrict the maximum path of the push button out of the housing, a further embodiment provides on the housing for a stop on which rests the projection of one of the levers under the effect of the elastic element acting on the push button. This establishment of the outer switching position of the push button produces an even bearing of the lever projection on the stop, assuring an easy detachment of the projection from the stop in actuating the push button.

Arranged in the housing is suitably a printed circuit board with a switching element mounted on it, the spring-loaded button of which element causes the push button to restore automatically. Also installed on the printed circuit board is preferably an illuminating element whose bulb is received in the opening of a luminescent screen. Using a printed circuit board with components arranged on it makes it possible to obtain in a simple fashion different wiring patterns and switching functions, without involving any change in the type of assembly.

To obtain a defined illumination of the push button, an advancement of the invention provides for fabricating the push button as a two-color injection-molded part whose outer shell is luminescent and its inner shell opaque, with brackets molded to the inner shell for a clip connection with the luminescent screen, and posts for receiving the pivot bearings. The material of the inner shell is thus able to withstand the high stresses of the clip connection, and the material of the outer shell is available evenly over the entire surface of the push button. Hence, also a desired symbol can be molded in the push button.

An alternative way to accomplish the objective underlying the invention is characterized in that in the housing there is arranged a guide surface on which bears the bar under the effect of an elastic element, with the entrainment bearings in the bar fashioned as slot and matching pins molded to the projection of the levers for engagement of the slots. The elastic element bears preferably with its one end on the bottom of a blind hole in the bar and with its other end on a contact bridge, with entrainment shoulders of the contact bridge fitted in openings in the bar and with the contact bridge interacting with electric contacts in the bottom of the housing. Achieved thereby, besides a reliable actuation of the push-button switch as well as the tolerance compensation, are high currents and switching capacities with the push-button switch. Furthermore, the bar serves two functions, namely the forced entrainment of the levers and, thus, the push button, and additionally the function of a switching member, with the bar guiding the contact bridge and a sufficient contact force being always available through the compression spring underneath the contact bridge. The bottom of the housing may be designed differently, whereby also other switching states are achieved after exchange. Mounted at the bottom of the housing is suitably an illuminating element whose bulb is received in the opening of a luminescent screen.

Figure 4:
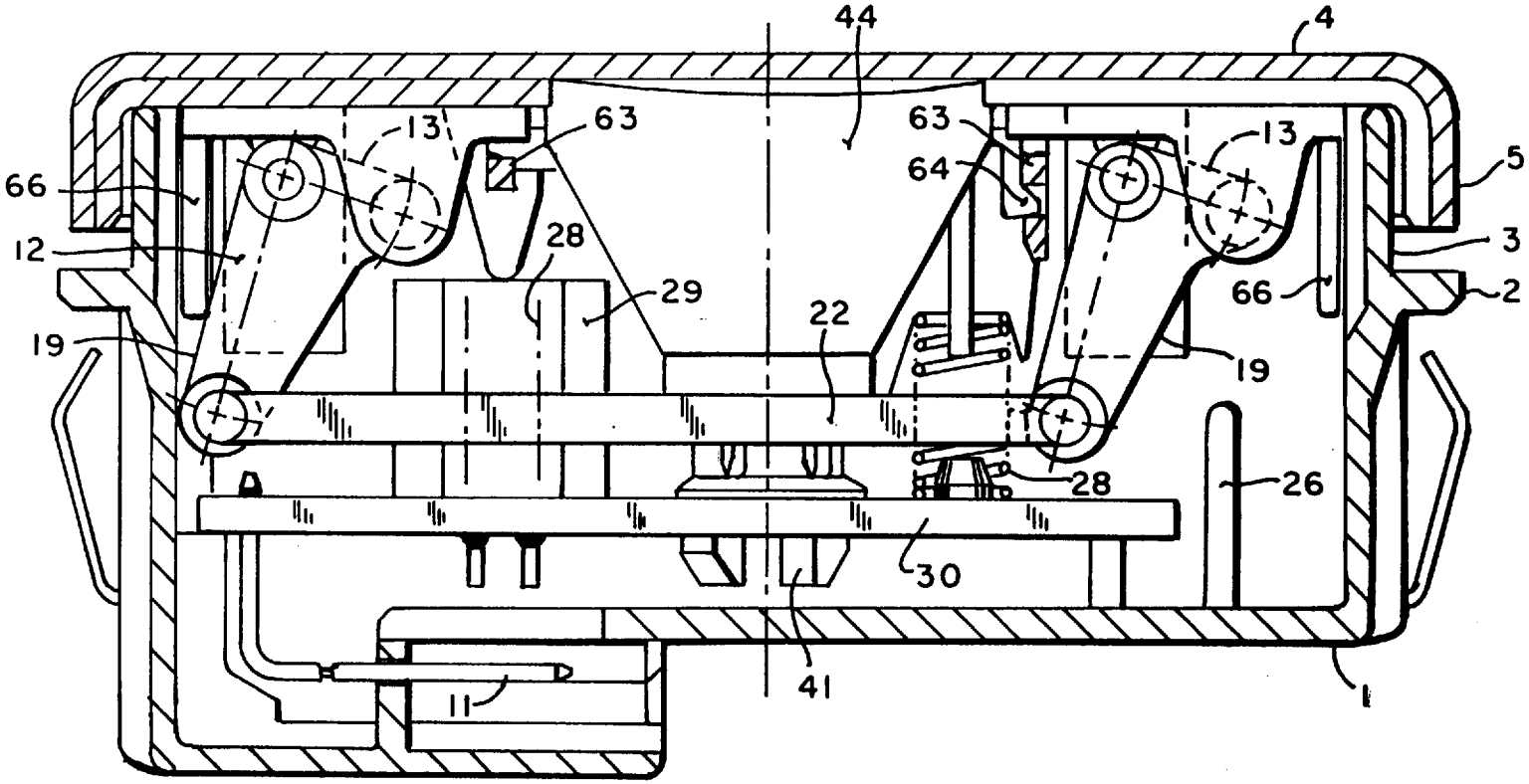
Figure 5:
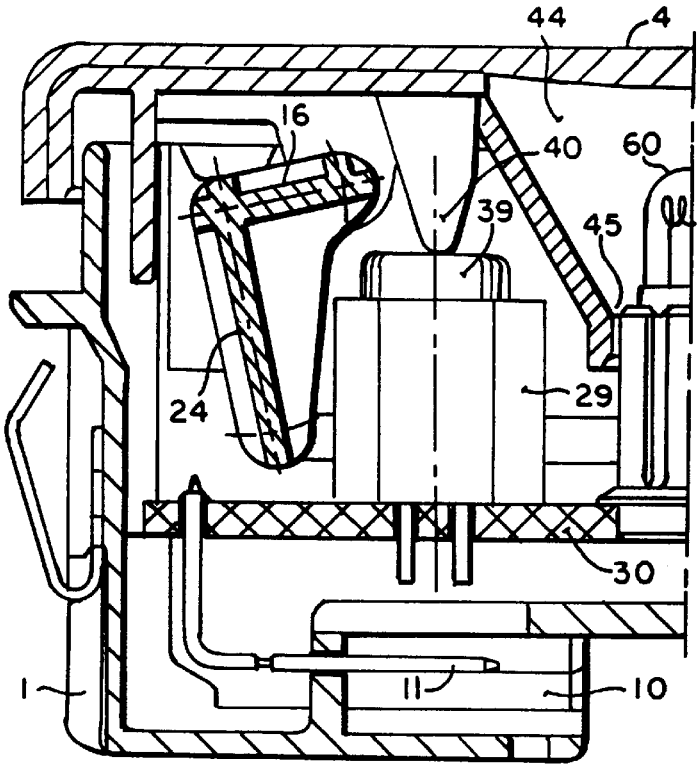
Figure 6:
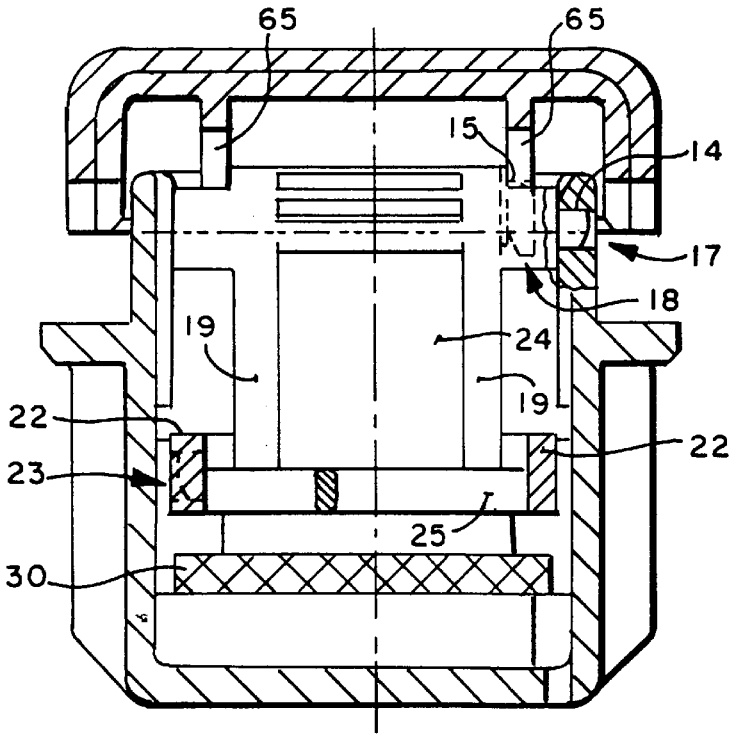
Figure 7:
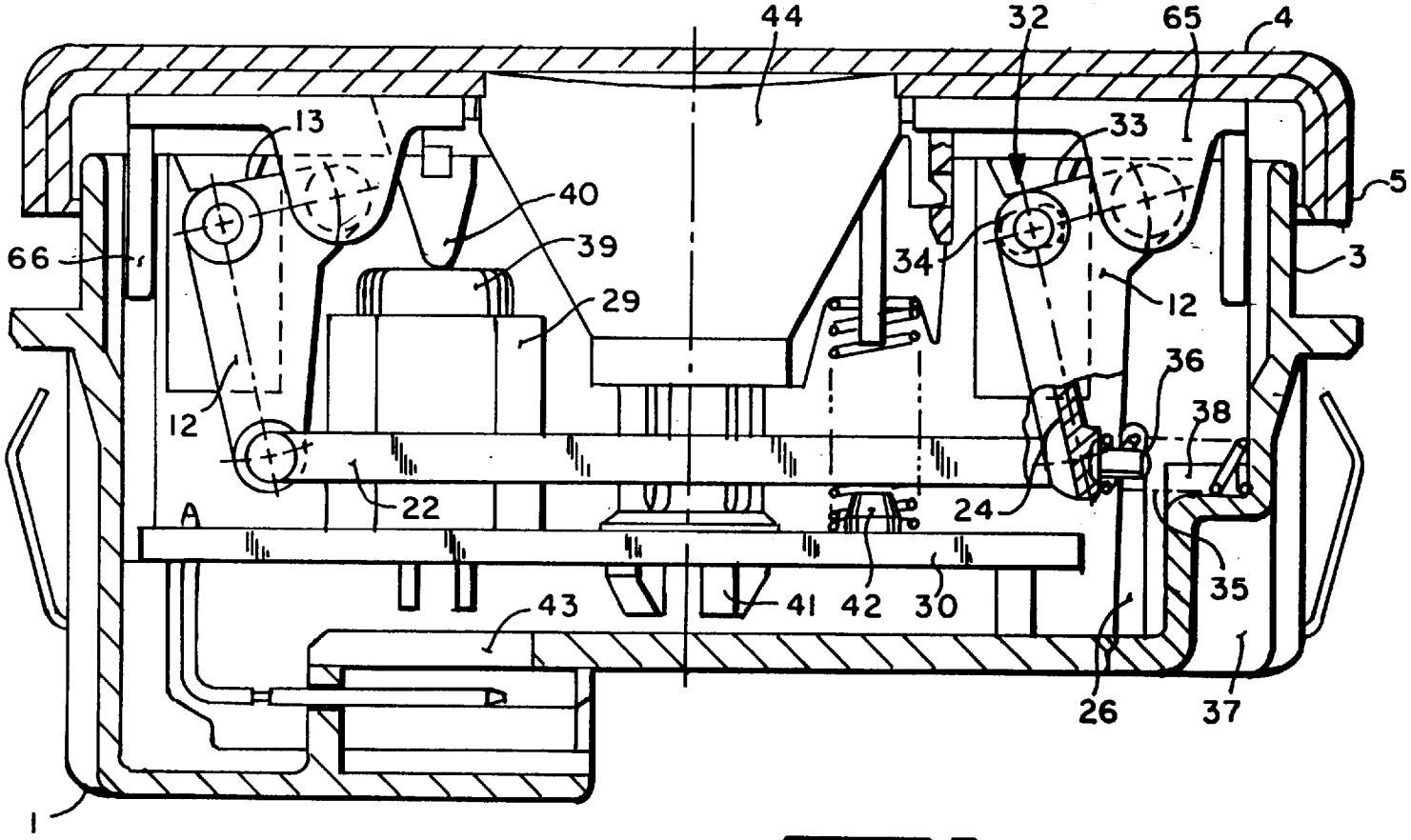
Figure 6:
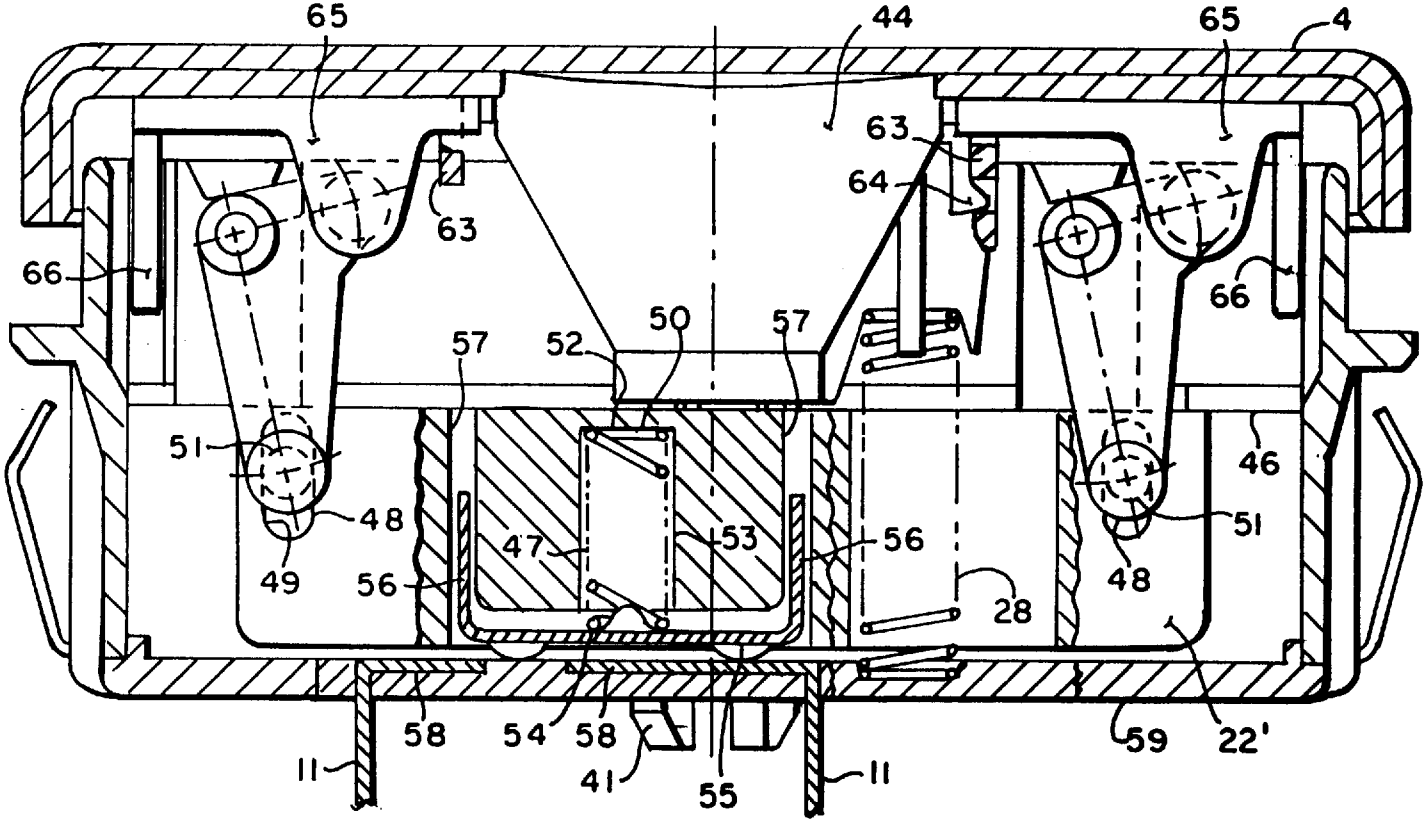

The following description explains the invention in greater detail, with the aid of the drawing. The push-button switch illustrated in FIG. 1 through 6 is not an embodiment of the invention, but only an example serving to facilitate understanding the invention. The drawing shows in FIG. 1, a view of the long side of an electric push-button switch;

FIG. 2, a side elevation of the electric push-button switch in the direction of arrow II;

FIG. 3, a section through an electric push-button switch according to FIG. 2 along line III-III, in unactuated state;

FIG. 4, a section through the electric push-button switch according to FIG. 3 in actuated state;

FIG. 5, a half-section through the electric push-button switch according to FIG. 2 along line V-V;

FIG. 6, a section through the electric push-button switch according to FIG. 1, along line VI-VI;

FIG. 7, an embodiment of the electric push-button switch according to the invention;

FIG. 8, an alternative embodiment of the electric push-button switch according to the invention.

The electric push-button switch has a cross-sectionally rectangular housing 1, a flange 2 surrounding the housing 1 and on it a skirt 3. The push button 4 reaches with its edge 5 over the skirt 3 of the housing 1. On the narrow sides of the rectangular housing 1, elastic clips 6 are mounted in a groove 8 over a serration 7. Guide strips 9 are molded to the long side of the housing 1 of the electric push-button switch. The electric pushbutton switch is mounted on a not illustrated panel with the aid of the clips 6 and guide strips 9; the flange 2 rests then on the top side of the panel. FIG. 1 and 2 show the electric push-button switch in its unactuated state; the double-dot-dash line shows the push-button switch 4 in its actuated state. Connector pins 11, for connection by means of a plug, are arranged in a receptacle 10.

In FIG. 3, guide elements 12 are visible, which consist of a lever 13 connecting the housing 1 and the push button 4 in jointed fashion. The lever 13 is arranged, for one, around a stationary bearing 14 in the housing 1 and, for another, on a stationary bearing 15, on the push button, which pivots about the housing-fixed bearing 14.

In the exemplary embodiment, four levers 13 are fitted between the housing 1 and the push-button 4, with two levers 13 each aligned coaxially and available in one-piece fashion via beams 16. For reason of material s, the beams 16 are fashioned as flat disks. To achieve a more convenient assembly of the levers 13 with the interposing beams 16 in the housing 1, this connection is designed as a clip 17: a clip 18 allows easy assembly of the lever to the push-button 4.

Molded integrally to the lever 13 is a projection 19 on the end 20 of which an entrainment bearing 21 is provided which pivots about the stationary bearing 14 in the housing 1. The entrainment bearing 21 located on the projection 19 of lever 13 is arranged pezpendicularly to the connecting line 27 between the stationary bearing 14 in the housing 1 and the pivotable bearing 15 on the push-button 4, wherein it stands is vertically on the axis of the stationary bearing 14 in the housing 1.

A further forced entrainment occurs in that at least two levers 13 with same pivoting direction of the projection 19 in the pivoting direction of entrainment bearing 21 are connected by a bar 22 by means of clips 23. Molded integrally to the beam 16 is a projection 24 that assures stability of the projections 19.

As the push-button 4 is actuated, the lever 13 pivots about the stationary bearing 14 in the housing 1, and the pivoting bearing 15 on the push-button 4 as well as the entrainment bearing 21 on the projection 19 clockwise and, as the push-button 4 is released, the lever 4 pivots with its molded ba s 15 and 21 counterclockwise. The forced entrainment is improved in that the four levers 13 between the housing 1 and the push-button 4 are by way of the bars 22, which are mounted in their entrainment bearings 21, connected to a rail 25 between the bars 22. The entrainment is thus direct and is not influenced additionally by manufacturing tolerances.

In the unactuated state of the push-button 4, which under the effect of an elastic element 28 is forced outward, the projection 19 bears on a stop 26 that limits the actuation stroke upwardly, AS the push-button 4 is actuated, the projection 19 swings away from the stop 26. In doing so, the push-button 4 is against the effect of the elastic element 28 which, for one, is contained in switching element 29, or alternatively is mounted between he circuit board 30 and a receiving means 31 on the push-button 4.

FIG. 7 shows an alternative embodiment. Here, with levers 13 connected by bars 22, a lever 13 is fitted in a stationary bearing 14 in the housing 1, and the bearings 32 for all further levers 33 are formed each by a slot 34 in the housing 1. Attached to the projection 19 of the lev 33 fitted in the slot 34 is a compression spring 35, its working direction being opposite to the push-button 4. For mounting the compression spring 35 on the beam projection 24 of lever 33, a pin 36 is molded to it and a depression 37 is molded in the housing 1, whose inner area is fashioned as a bowl 38 in which the compression spring 35 is located. Hence, the compression spring 35 bears with its one end on the inside wall of the housing 1 and with its other end on the beam projection 24 of lever 33.

Mounted in the housing 1 is a printed circuit board 30 containing a switching element 29. Provided in the switching element 29 is an elastic element 28 which moves the switching button 39 of the switching element 29 automatically to the outer switching position. A plunger 40 of the push-button 4 bears on the top side of the switching button 39 of the switching element 29, by way of which plunger the push-button 4 is moved to the outer switching position. The printed circuit board 30 contains the not illustrated lines for realizing the current paths between the connector pins 11, switching element 29 and illuminating element 41. The connector pins 11 and the switching element 29 are soldered in place, while the illuminating element 41 is mounted detachable. The top side of the printed circuit 30 contains a pilot pin 42 which fixes the elastic element 28 in its position. The connector pins 11 are bent over at right angles, and the housing 1 has in the area of the bend a void 43. The illuminating element 41 contains a bulb 60 that enters the interior of the luminescent screen 44 through the opening 45.

Illustrated in FIG. 1 is an alternative embodiment of the bar 22. In this exemplary embodiment, the housing 1 features a guide surface 46 on which the bar 22 bears under the effect of a compression spring 47. The bar 22 moves on this guide surface 46 always linearly. To enable such, the entrainment bearings 48 of the bar 22 are fashioned as slots 49, and appropriate pins 51 are molded to the projection 19 of the lever 13, which pins engage the slots 49 in the bar 22. The bar 22 is cross-sectionally appreciably wider and assumes the function of a switching member, in that the compression spring 47 bears with one end 50 on the bottom 52 of a blind hole 53 in the bar 22 and with its other end 54 on a contact bridge 55, the entrainment shoulder 56 of the contact bridge 55 being fitted in openings 57 of the bar 22 and the contact bridge 55 interacting in the bottom 59 of housing 1 with contacts 58 that lead to the connector pins 11. The bottom 59 is fastened to the housing 1 by a not illustrated clip. Fastened to the bottom 59 of the housing 51 is an illuminating element 41, the bulb 60 of which is received in the opening 45 of a luminescent screen 44.

The push-button 4 is fabricated as a two-color injection molding whose outer shell 61 consists of luminescent material, while its inner shell 62 is opaque. The bracket 63 molded to the inner shell 62, for a clip 64 of the luminescent screen 44, and the shanks 65 for receiving the pivoting bearings 15 of the push-button 4 are molded integrally. Besides, guide bracken 66 are molded to the inner shell, which are received in the housing 1 with much backlash.

We claim:

1. A push-button switch assembly comprising:

(a) a housing having a switching element therein with a moveable actuator;

(b) a pair of levers each pivotally mounted in spaced relationship on said housing for pivotal movement thereon about substantially parallel axes;

(c) a link having an end portion thereof pivotally connected to each of said levers on a common side of said pivotal mounts;

(d) an elongated push-button having an end portion pivotally connected to each of said levers on a common side of said pivotal mounts; and, (e) means biasing said push-button in a direction outwardly of said housing, wherein said pivotal mount for one of said levers is disposed for sliding movement on said housing.

2. The switch assembly defined in claim 1 wherein said push-button, said levers and said link are arranged as a four-bar linkage.

3. The switch assembly defined in claim 1 wherein said link comprises a pair of bars disposed in spaced parallel arrangement with each bar disposed on an opposite side of said levers.

4. The switch assembly defined in claim 1 wherein each of said levers includes integrally formed therewith a film hinge for retaining an end of said link pivotally connected thereto.

5. The switch assembly defined in claim 1 wherein said pivotal connection of said link to each of said levers comprises a pin molded as part of each lever, with each said pin engaging a slot in said link.

6. The switch assembly defined in claim 1 wherein said switch element includes a stationary contact associated with said housing and a moveable contact associated with said link.

7. The switch assembly defined in claim 1 wherein said switch element includes a moveable contact associated with said link and a stationary contact associated with said housing, wherein said moveable contact is resiliently biased against said stationary contact.

8. The switch assembly defined in claim 1 wherein said pivotal connection of said levers to said link includes a slotted connection.

* * * * *